US008821244B1

(12) United States Patent
Detlefsen et al.

(10) Patent No.: US 8,821,244 B1
(45) Date of Patent: Sep. 2, 2014

(54) EXTENDING PRESENTATION OF MOOD-RELATED GAMING EFFECTS

(75) Inventors: David E. Detlefsen, Northfield, IL (US); Michael V. Dicillo, Norridge, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/606,230

(22) Filed: Sep. 7, 2012

(51) Int. Cl.
*G07F 17/32* (2006.01)

(52) U.S. Cl.
USPC ..... 463/16; 463/20; 463/25; 463/31

(58) Field of Classification Search
USPC ..... 463/16, 20, 25, 29, 31
See application file for complete search history.

(56) References Cited

U.S. PATENT DOCUMENTS

| | | | | |
|---|---|---|---|---|
| 6,328,648 | B1 | 12/2001 | Walker et al. | |
| 6,648,762 | B2 | 11/2003 | Walker et al. | |
| 7,662,040 | B2 | 2/2010 | Englman et al. | |
| 7,780,531 | B2 | 8/2010 | Englman et al. | |
| 7,931,530 | B2 | 4/2011 | Anderson et al. | |
| 2005/0164786 | A1 | 7/2005 | Connelly | |
| 2006/0073881 | A1 | 4/2006 | Pryzby et al. | |
| 2006/0287037 | A1 | 12/2006 | Thomas | |
| 2008/0045341 | A1 | 2/2008 | Englman | |
| 2008/0096666 | A1 | 4/2008 | Pryzby et al. | |
| 2011/0092288 | A1 * | 4/2011 | Pryzby et al. | 463/35 |
| 2011/0223993 | A1 | 9/2011 | Allen et al. | |
| 2012/0115592 | A1 | 5/2012 | Gagner et al. | |

* cited by examiner

*Primary Examiner* — Omkar Deodhar

(74) *Attorney, Agent, or Firm* — DeLizio Gilliam, PLLC

(57) ABSTRACT

A wagering game system and its operations are described herein. In some embodiments, the operations can include detecting a winning event during a wager cycle of a wagering game played during a wagering game session. In some embodiments, the operations further include presenting a congratulatory gaming effect in response to the winning event and extending presentation of the congratulatory gaming effect for a duration after the wager cycle.

23 Claims, 8 Drawing Sheets

EXTENDING PRESENTATION OF MOOD-RELATED GAMING EFFECTS

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

TECHNICAL FIELD

Embodiments of the inventive subject matter relate generally to wagering game systems and networks that, more particularly, extend presentation of mood-related gaming effects.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play. For example, sound effects, light effects, and other environmental devices played in connection with a wagering game help to immerse a wagering game player ("player") into a wagering game experience and add to the excitement and fun of wagering games. Therefore, the gaming industry can greatly benefit from new gaming enhancements that use environmental gaming effects, such as to increase the excitement, efficacy, or other aspects of the wagering game experience.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operations performed by some embodiments while the third section describes additional example embodiments. The fourth section describes example operating environments while the fifth section presents some general comments.

Introduction

This section provides an introduction to some embodiments of the inventive subject matter ("embodiments").

Figure 1:
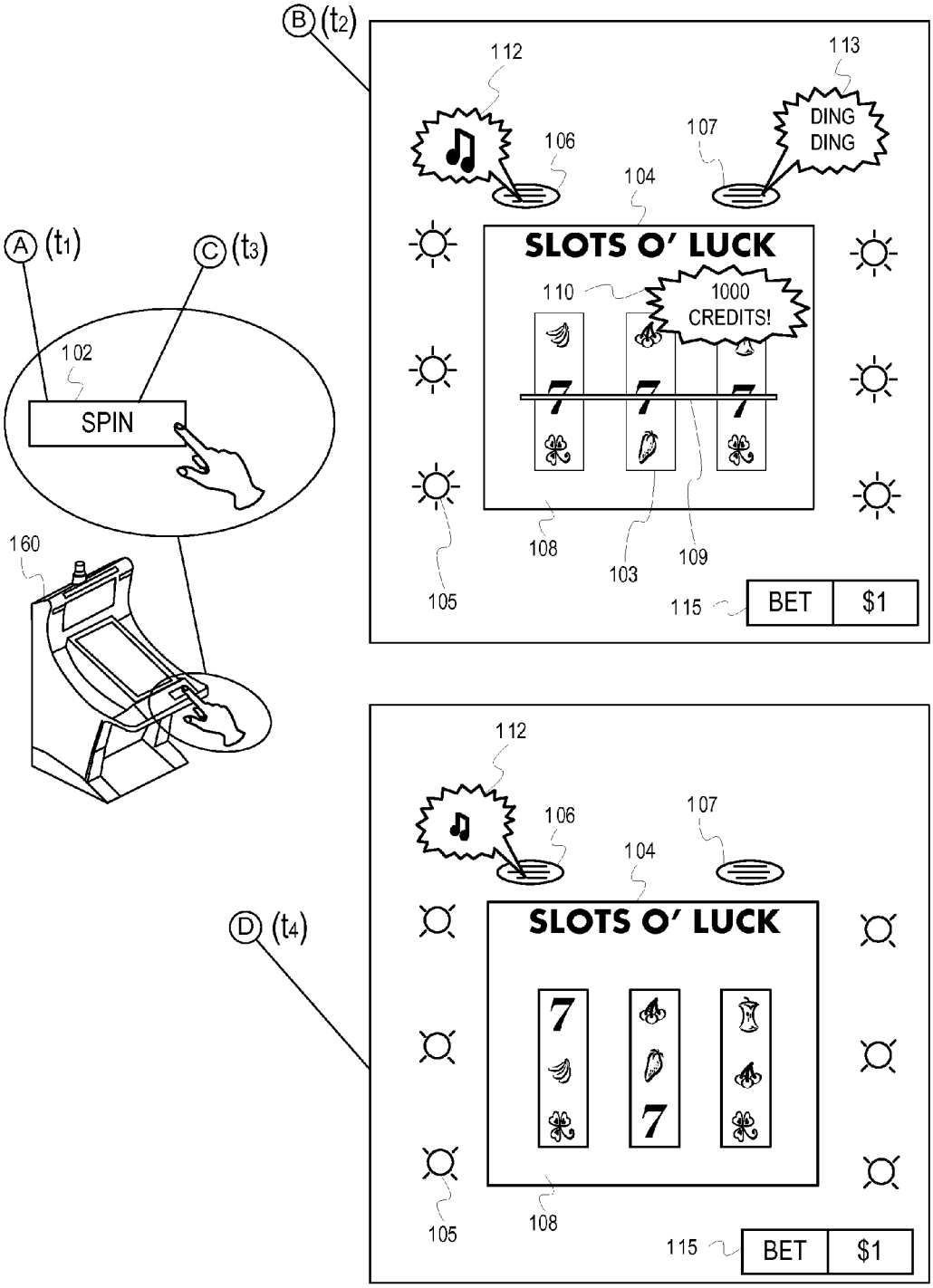
FIG. 1 is a conceptual diagram that illustrates an example of extending presentation of mood-related gaming effects across wager cycles, according to some embodiments.

FIG. 1 is a conceptual diagram that illustrates an example of extending presentation of mood-related gaming effects across wager cycles, according to some embodiments. In FIG. 1, a wagering game system ("system") includes a wagering game machine 160 that presents a wagering game 108. The wagering game includes wagering game elements, such as reels 103 that spin and stop to reveal a configuration of reel symbols that align in either winning or losing configurations, according to game rules. At a first phase, "phase A" (at a first time $t_1$), the system detects when a player places a wager in the wagering game 108 and initiates play of the wagering game 108 for the wager. For instance, the system detects that the player specifies a bet amount (e.g., the $1 credit amount indicated in the bet meter 115) and the system detects that the player activates a spin button 102 on the wagering game machine 160.

At phase "B" (at a second time $t_2$ after the first time $t_1$), in response to the when the player pressed the spin button 102, the system causes wagering game elements to perform a game related action (e.g., the system causes the reels 103 to spin and stop in a configuration that either wins or loses according to game rules). In the example at phase "B," the wagering game 108 results in a win. When the win occurs, the wagering game presents some gaming effects that celebrate the win (e.g., a "celebratory gaming effect"). The celebratory gaming effect helps to set a mood for the player by presenting interesting and exciting lights and sounds within the environment surrounding the player. For instance, when the win occurs, the wagering game machine 160 flashes environmental lighting devices (e.g., emotive lighting 105) and/or blasts upbeat music 112 and sounds 113 from speakers 106 and 107 associated with the wagering game machine 160. The system also presents celebratory graphics on a display 104, such as a payline 109 and a celebratory message 110. The lights, sounds, graphics, etc. help to invoke a celebratory feeling. The celebratory gaming effect is an example of a mood-related gaming effect. Other examples of mood-related gaming effects are described in further detail in FIG. 2.

Some embodiments maintain a presentation of the mood-related gaming effect across wager cycles of the wagering game 108. For example, at phase "C" (at a third time $t_3$ which is after the second time $t_2$), the system detects an additional wager and game play (e.g., the system detects that the player presses the spin button 102 again). When the player presses the spin button 102 the second time, a wager cycle ends for the first wager and spin associated with phases "A" and "B" and a second wager cycle begins.

At phase "D" (at a fourth time $t_4$ which is after the third time $t_3$), the system causes the reels 103 to spin again for the second wager. However, at phase "D" the spin does not result in a winning outcome (i.e., the symbols on the reels 103 do not align into a winning configuration). Nevertheless, because of the previous winning outcome at phase "B," the system extends the presentation of the celebratory gaming effect. For example, the system continues to produce some mood lighting from the emotive lights 105 and the system continues to play the music 112 from the speaker 106. Therefore, although the moment associated with the previous win may have passed, and although a subsequent losing outcome occurs, the system extends a presentation of at least some of the celebratory effect from the previous win, thus extending the mood of the win into subsequent wager cycles. In some embodiments, in the second wager cycle and beyond into additional wager cycles, the system reduces the intensity of the gaming effect gradually, or in stages, from when it was previously presented in the previous wager cycle, such as by increasingly reducing the intensity of the light levels produced by the emotive lights 105 and/or reducing the volume of the music 112 over time and/or at the start of each new wager cycle, until no more remnants of the celebratory gaming effect are presented.

Although FIG. 1 describes some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Figure 2:
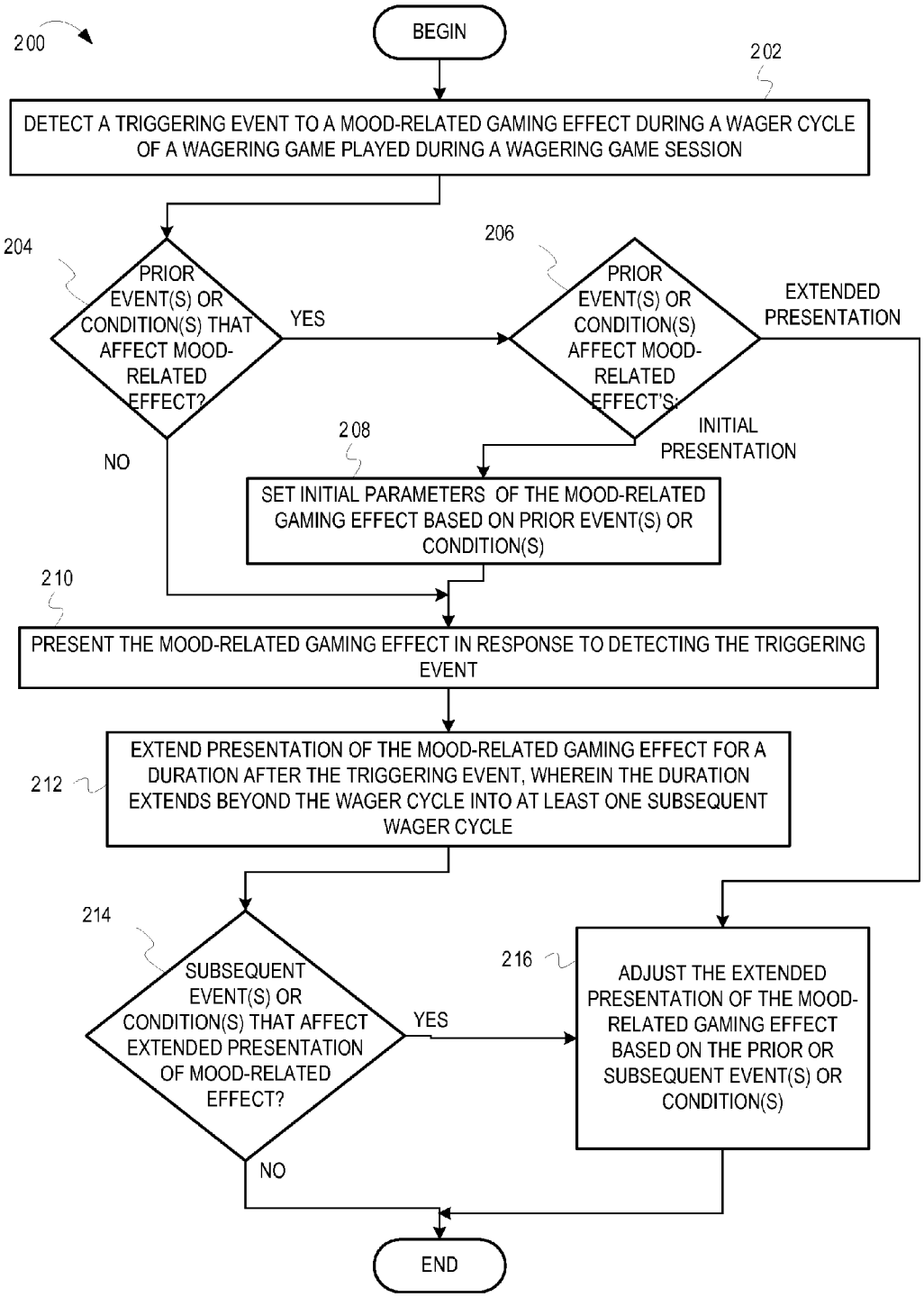
FIG. 2 is a flow diagram 200 illustrating extending presentation of mood-related gaming effects across wager cycles according to gaming events, according to some embodiments.
Figure 3:
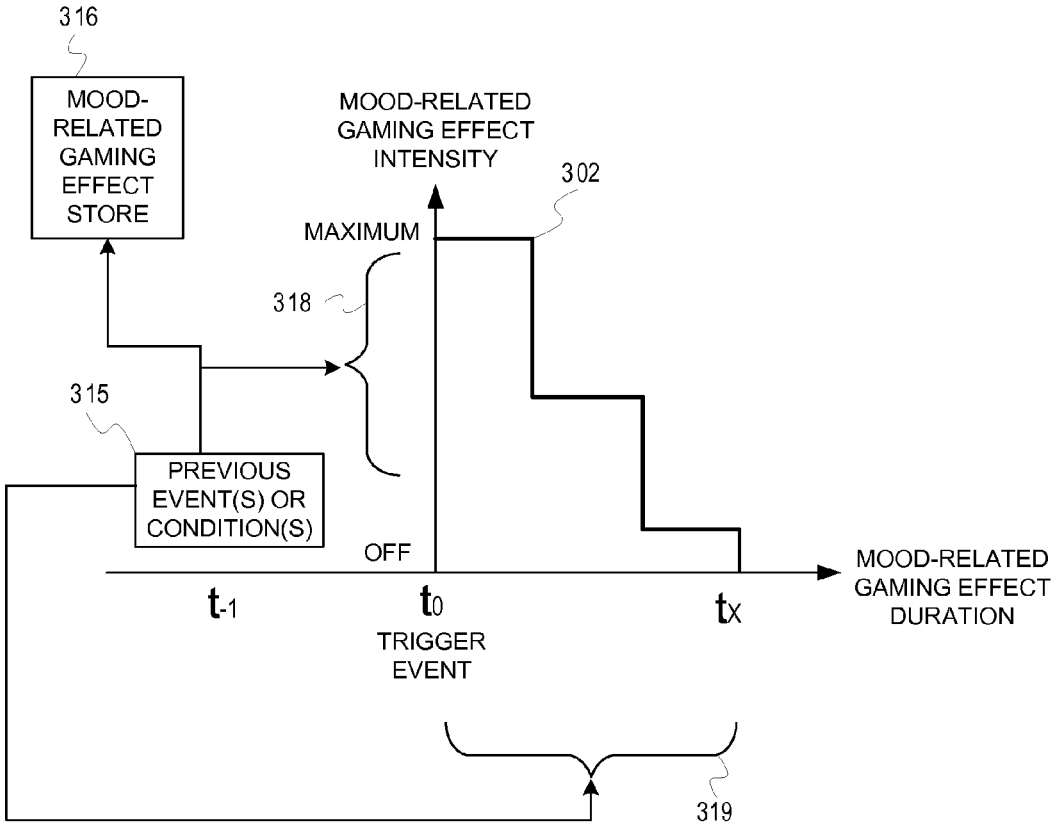
FIG. 3 is an illustration of controlling presentation and/or extension of mood-related gaming effects according to previous events, according to some embodiments.
Figure 4:
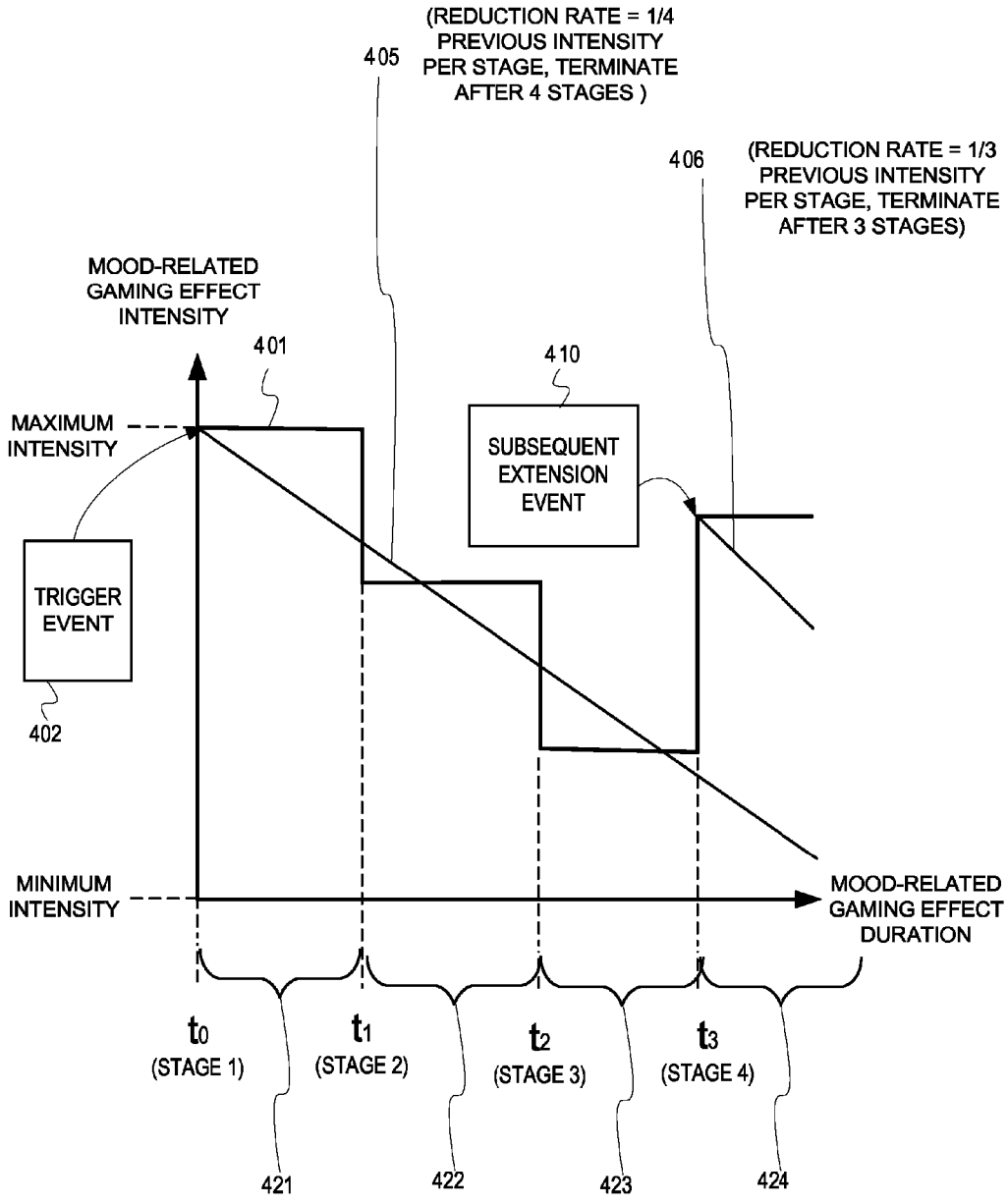
FIG. 4 is an illustration of extending presentation of mood-related gaming effects across stages according to gaming events, according to some embodiments.

FIG. 2 is a flow diagram ("flow") 200 illustrating extending presentation of mood-related gaming effects across wager cycles according to gaming events, according to some embodiments. FIGS. 3 and 4 are conceptual diagrams that help illustrate the flow of FIG. 2, according to some embodiments. This description will present FIG. 2 in concert with FIGS. 3 and 4. In FIG. 2, the flow 200 begins at processing block 202, where a wagering game system ("system") detects a triggering event to a mood-related gaming effect during a wager cycle of a wagering game played during a wagering game session. For example, as in FIG. 1, the system detected a winning event (e.g., a winning outcome of a playing turn of a wagering game) during a wager cycle of a wagering game session.

Mood-related gaming effects are special effects that set a mood for the event. Some of the mood-related gaming effects can be related to a positive event, such as occurrence of a game win, a level-up, an upgrade, a virtual trophy or accomplishment, a group advancement, a persistent-game achievement, an invitation to a tournament, etc. Other mood-related gaming effects can be presented in response to neutral or non-positive events. For example, the system may present an anticipatory notification (e.g., that an upcoming event may occur or will occur soon) and, in conjunction with the notification, present a mood-related gaming effect. The mood-related gaming effect for the notification, however, can extend beyond a specific period associated with the notification to heighten the anticipation of the upcoming event. In some examples, a negative event may occur, such as a loss or a near miss (i.e., when a player nearly wins or nearly obtains an achievement). The system may present a conciliatory effect to console the player with an upbeat presentation of lights, sounds, etc. Some mood-related gaming effects may be related to another player's accomplishments. For instance, if a friend wins a game, then the system may present a mood-related gaming effect at the friend's wagering game machine as well as at other wagering game machines. Some mood-related gaming effects can be classified as environmental effects, such as effects that occur on hardware devices other than a primary display on which a wagering game is presented. For example, environmental effects are presented via devices in a player's immediate surroundings, such as emotive lighting, overhead lighting, peripheral displays, overhead displays, speakers, a personal mobile device, etc.

The flow 200 continues at processing block 204, where the system determines whether prior event(s) occurred or condition(s) existed that would affect presentation of the mood-related gaming effect. If not, then the flow 200 continues at processing block 219. If so, then the flow 200 continues at processing block 206.

At processing block 206, the system determines whether the prior event(s) or condition(s) affect the initial presentation or extended presentation of the mood-related gaming effect. In some embodiments, the system determines whether the prior event(s) or condition(s) affect the initial presentation or extended presentation by accessing a data store (e.g., a listing, a database, a configuration file, etc.) that indicates types of events or conditions that will have an effect on the mood-related presentation. Some events or conditions are related to wagering game play or activities performed by the player that are worthy of rewards or that have been specified as being events or conditions that will be rewarded with specific mood-related presentations and/or extension of presentations of mood-related gaming effects. In some embodiments, the some of the events or conditions are classified as affecting the initial presentation of the mood-related gaming effect, the extension of the duration of the mood-related gaming effect, or both.

In some embodiments, wagering game manufacturers pre-specify the events or conditions related to a player's history that will affect the presentation of the mood-related gaming effects. The wagering game manufactures can store the pre-specified events or conditions in the data store and associate the data store with light shows, soundtracks, celebratory subroutines, etc. When the triggering event occurs, the system refers to the data store, determines the events or conditions, then analyzes a player account's history to determine whether the player account has a history of the events or conditions. If so, then the system can set parameters for the presentation or for extended presentation of the mood-related event. For example, the system can replace first parameters, for a default presentation duration of the gaming effect, with second parameters, for an extended presentation duration of the gaming effect. The first parameters cause an intensity reduction of the gaming effect to occur at a first rate (e.g., to reduce an intensity of the gaming effect to a minimum level or to turn off when a first wager cycle ends). The second parameters cause an intensity reduction of the congratulatory gaming effect to occur at a second rate less than the first rate (e.g., to reduce an intensity of the gaming effect to the minimum level in stages via subsequent wager cycles).

In some embodiments, the system includes a configuration tool where a gaming operator, a player, or entity, can specify the events or conditions.

The following are some examples of events or conditions prior to the triggering event that may affect presentation and/or extended presentation of a mood-related gaming effect.

A Spin History of a Player Account.

In some embodiments, the system tracks a degree of spins or results of spins by the player account.

An Average Speed of Play.

In some embodiments, the system tracks how often a player plays a wagering game (e.g., how quickly the player has performed previous wager cycles).

An Amount Wagered Over Time.

In some embodiments, the system tracks an amount of money that a player has wagered in a wagering game session and/or in previous wagering game sessions.

An Amount of Time of Play of a Player Account.

In some embodiments, the system tracks an amount of time that a player has spent playing wagering games in a wagering game session and/or in previous wagering game sessions.

A Prior Advantageous Outcome.

In some embodiments, the system detects game results from previous games and/or combinations of results from various games (e.g., a specific reel-stop combination from a slot game combined with a specific card hand from a card game) as criteria for presentation and/or extended presentation and stores the data in the player account.

A Player Status.

In some embodiments, the system tracks events that increase a player's status (e.g., a status that recognizes or indicates a degree of loyalty by the player to a specific game manufacturer or casino, an amount of money that a player has wagered in a wagering game session and/or in previous wagering game sessions, etc.). In some embodiments, player status increases based on non-wagering game play, such as for purchases of merchandise by a casino and/or an affiliate of the casino or game manufacturer, participation in casino activities that are non-gaming, or activities performed via a social network.

An Amount of Points Collected.

In some embodiments, during previous play of wagering games, or for other activities, the system may reward points that collect over time. The amount of points can be used to increase intensity of presentation of a mood-related gaming effect and/or to extend a presentation of the mood-related gaming effect a specific amount of time per each point.

The flow 200 continues at processing block 208, where the system sets initial parameters of the mood-related gaming effect based on the prior event(s) or condition(s). Examples of initial parameters may include, but are not limited to, one or more of the following: a type of mood-related gaming effect to present, an initial effect intensity, a number of elements to present for the mood-related gaming effect, etc. FIG. 3 illustrates an example of how previous event(s) or condition(s) can affect the presentation and extension of presentation of a mood-related gaming effect. In FIG. 3 a graph 302 illustrates an intensity level of a mood-related gaming effect from maximum to minimum levels over a duration 319 (i.e., from time $t_0$ to time $t_x$). At time $t_0$, a triggering event occurs, such as a win event in a wagering game. However, prior to the trigger event (e.g., at time $t_1$), previous event(s) occurred and/or condition(s) existed ("previous event(s) or condition(s) 315") that affect an intensity range 318 of the mood-related gaming effect or the duration 319 at the time $t_0$ and afterwards until time $t_x$. In some embodiments, the system detects the previous event(s) or condition(s) 315 and selects from a mood-related gaming effect store 316 to select specific types of events (e.g., specific light shows, specific sound playlists, etc.) for the mood-related gaming effect based on the previous event(s) or condition(s) 315. The system can further set initial parameters for times and reduction rates for the specific types of events.

The flow 200 continues at processing block 210, where the system presents the mood-related gaming effect in response to detecting the triggering event. For example, the system presents a congratulatory gaming effect in response to a winning event that occurs as similarly described in FIG. 1. In some embodiments, the congratulatory effect is presented via at least one hardware device associated with a wagering game machine other than a display on which the wagering game is presented, such as via emotive lighting, overhead lighting, peripheral displays, speakers, etc. In some embodiments, the system presents the mood-related gaming effect via a personal mobile device (e.g., a smartphone, a tablet computer, etc.). associated with the player of the wagering game.

The flow 200 continues at processing block 212, where the system extends presentation of the mood-related gaming effect for a duration after the triggering event, wherein the duration extends beyond the wager cycle into at least one subsequent wager cycle. For example, the system extends presentation of a congratulatory gaming effect for a duration after an initial wager cycle across subsequent wager cycles as similarly described in FIG. 1. In some embodiments, a wager cycle comprises a placement of a wager, a transaction of the wager via a player account associated with the wagering game session, a playing turn of the wagering game for the wager, and a presentation of a winning outcome for the playing turn. In some embodiments, a subsequent wager cycle comprises a placement of an additional wager, a transaction of the additional wager via the player account associated with the wagering game session, an additional playing turn of the wagering game for the additional wager, and a presentation of a losing outcome for the additional playing turn. The losing outcome does not invoke an additional triggering event. The wager cycle may include a period of a bonus game, or secondary games, that occur as the triggering event or in response to the triggering event (e.g., in response to a win or accomplishment in a primary wagering game, the bonus game is initiated).

In some embodiments, the system extends presentation of the mood-related gaming effect based on a characteristic of the triggering event (e.g., a degree of a win, an amount of a wager associated with the win, a number of times the win has occurred, a theme associated with the wagering game in which the win occurred, etc.).

In some embodiments, the system extends presentation of the mood-related gaming effect based on a characteristic of a player account associated with the wager cycle (e.g., a gender, age, or demographic characteristics associated with the player, a number of social contacts of the player that have also experienced the trigger-event, a degree of time since the last time a player won, etc.).

In some embodiments, the system reduces the extended presentation gradually by degrees and/or in stages. In some embodiments, the system reduces the intensity of the mood-related gaming effect gradually based on time, specific conditions, or additional events. Some additional examples of reducing the extended presentation of the mood-related gaming effect gradually by degrees and/or in stages include, but are not limited to, the following:

- Reduce the intensity of the mood-related gaming effect for each successive wager cycle or group of wager cycles. The system reduces the intensity of the mood-related gaming effect by a certain degree for each subsequent wager cycle or group of wager cycles (e.g., the system reduces the intensity of the mood-related gaming effect by a given degree from one reel spin to the next for a slot game, the system reduces the intensity of the mood-related gaming effect after a given number of wager cycles, etc.).
- Reduce the mood-related gaming effect according to time intervals. The system reduces the intensity of the mood-related gaming effect by a certain degree for each successive time period (e.g., for each minute after the initial presentation of the mood-related gaming effect the system reduces the mood-related gaming effect to a specific degree).
- Reduce intensities of elements of a mood-related gaming effect differently. The system can reduce the intensity for different elements of the mood-related gaming effects according to different rates (e.g., reduce the light effects at a slower rate than the sound effects).
- Reduce a number of the elements of a mood-related gaming effect. The system reduces the intensity of the mood-related gaming effect by reducing a number of elements of the mood-related gaming effect (e.g., reduce certain sounds before other sounds, reduce certain instruments in a sound track at different rates over the duration, successively turn off more of specific lights from a light bar, etc.).
- Reduce the intensity of elements of a mood-related gaming effect according to priorities. The system reduces the intensity of specific elements of the mood-related gaming effect according to priorities (e.g., remove vibration elements before sound elements, remove sound elements before light elements, remove presentation of elements further from a main display of a wagering game machine before removing presentation of elements closer to the main display, etc.).

FIG. 4 illustrates an example of reducing the extended presentation of the mood-related gaming effect in stages. In FIG. 4, a graph 401 indicates an intensity of at least one element of a mood-related gaming effect across at least four stages (i.e., first stage 421, second stage 422, third stage 423 and fourth stage 424). In some embodiments, each of the stages 421, 422, 423, and 424 corresponds to one wager cycle or one group of wager cycles. At a first time (time "$t_0$") a trigger event 402 occurs that initiates the mood-related gaming effect at a maximum intensity level. The mood-related gaming effect maintains the maximum intensity level for a duration of the first stage 421 after occurrence of the triggering event. At a second time (time "$t_1$"), the first stage 421 ends and the second stage 422 begins. In one example, as in FIG. 1, the second stage 422 may be initiated when the player presses the button 102 a second time at phase "C." Referring again to FIG. 4, in the second stage 422, the intensity of the mood-related gaming effect drops by a certain degree. The amount that the intensity drops is based on a reduction criteria, such as a reduction rate 405. The reduction rate 405 is assigned to the mood-related gaming effect when it is initiated. The reduction rate 405 indicates that for each stage of the extended presentation of the mood-related gaming effect, the system reduces the intensity of the presentation. For example, the system causes an intensity output value sent to output devices to decrease according to the reduction rate 405 at each of the stages (e.g., at the beginning of a subsequent wager cycle, the system causes an output intensity value for luminosity of emotive lights to drop by 25% of their previous intensity output value from the previous wager cycle). After four subsequent stages, the system reduces the intensity of the mood-related gaming effect to a minimum value (e.g., the system turns off the mood-related gaming effect or reduces the intensity to zero, the system reduces the effect to a default minimum level, etc.). Therefore, at the beginning of the second stage 422 (or at the end of the first stage 421), the system reduces the intensity of the mood-related gaming effect according to the reduction rate 405. At subsequent stages, such as at the initiation of the third stage 423, the system again reduces the intensity of the mood-related gaming effect.

The flow 200 continues at processing block 214, where the system determines whether subsequent event(s) occur, or whether certain condition(s) exist, that affect the extended presentation of the mood-related gaming effect. If so, then the flow 200 continues at processing block 216, where the system adjusts the extended presentation of the mood-related gaming effect based on the prior or subsequent event(s). The system can determine which additional events and/or conditions affect the extended presentation as similarly described at processing blocks 204 and 206. Some examples of additional events or conditions can include one or more of the events and/or conditions described at processing blocks 204 and 206 that occurred or existed prior to the triggering event. Furthermore, subsequent events or conditions may include similar types of events or conditions as the prior events or conditions, but occur or exist after the triggering event. For example, referring again to FIG. 4, the system detects a subsequent extension event 410 that causes an increase in intensity of the mood-related gaming effect. The subsequent extension event may include any of a number of types of events, such as (1) detection of a placement of a maximum bet amount for the fourth stage 424, (2) detection that the rate of play increased during the first three stages compared to a history of prior rate of play, (3) a new winning event, etc. In addition to and/or instead of, increasing the intensity of the mood-related gaming effect, the system can also cause an extension in presentation of the mood-related gaming effect because of the subsequent extension event 410. For example, in some embodiments, the subsequent extension event 410 can prevent a reduction of intensity of at least one element of the mood-related gaming effect (e.g., to cause the intensity to stay at a given level for a specific duration). In another example, in response to the subsequent extension event 410, the system can cause the rate of reduction 405 to become less severe (e.g., to reduce an intensity reduction factor from 25% reduction to 10% reduction), thus extending the duration of the extended presentation. In FIG. 4, the system causes the intensity of the mood-related gaming effect to increase at the start of the fourth stage 424. In some embodiments, after the fourth stage 424, the system can apply the same reduction rate as before (i.e., reduction rate 405). However, the system can instead apply a different reduction rate 406. Reduction rate 406, for example, reduces the intensity of the mood-related gaming effect by a third per subsequent stage and terminates the mood-related gaming effect after three subsequent stages.

If at processing block 214, there are no subsequent events(s) or conditions(s), then the process ends and the mood-related gaming effect terminates or drops to a minimum level. For example, in FIG. 4, if the subsequent extension event 410 had not occurred, the intensity of the mood-related gaming effect would have dropped to the minimum level (e.g., the "off" level) after the fourth stage 424, according to the reduction rate 405. In some embodiments, the minimum level is not necessarily an "off" setting, but may be a low level (e.g., music continues to play indefinitely at a very low volume level until another trigger event occurs).

Additional Example Embodiments

According to some embodiments, a wagering game system ("system") can provide various example devices, operations, etc., to extend presentation of mood-related gaming effects. The following non-exhaustive list enumerates some possible embodiments.

Controlling Presentation and/or Extension of Mood-Related Gaming Effects for Groups.

Figure 5:
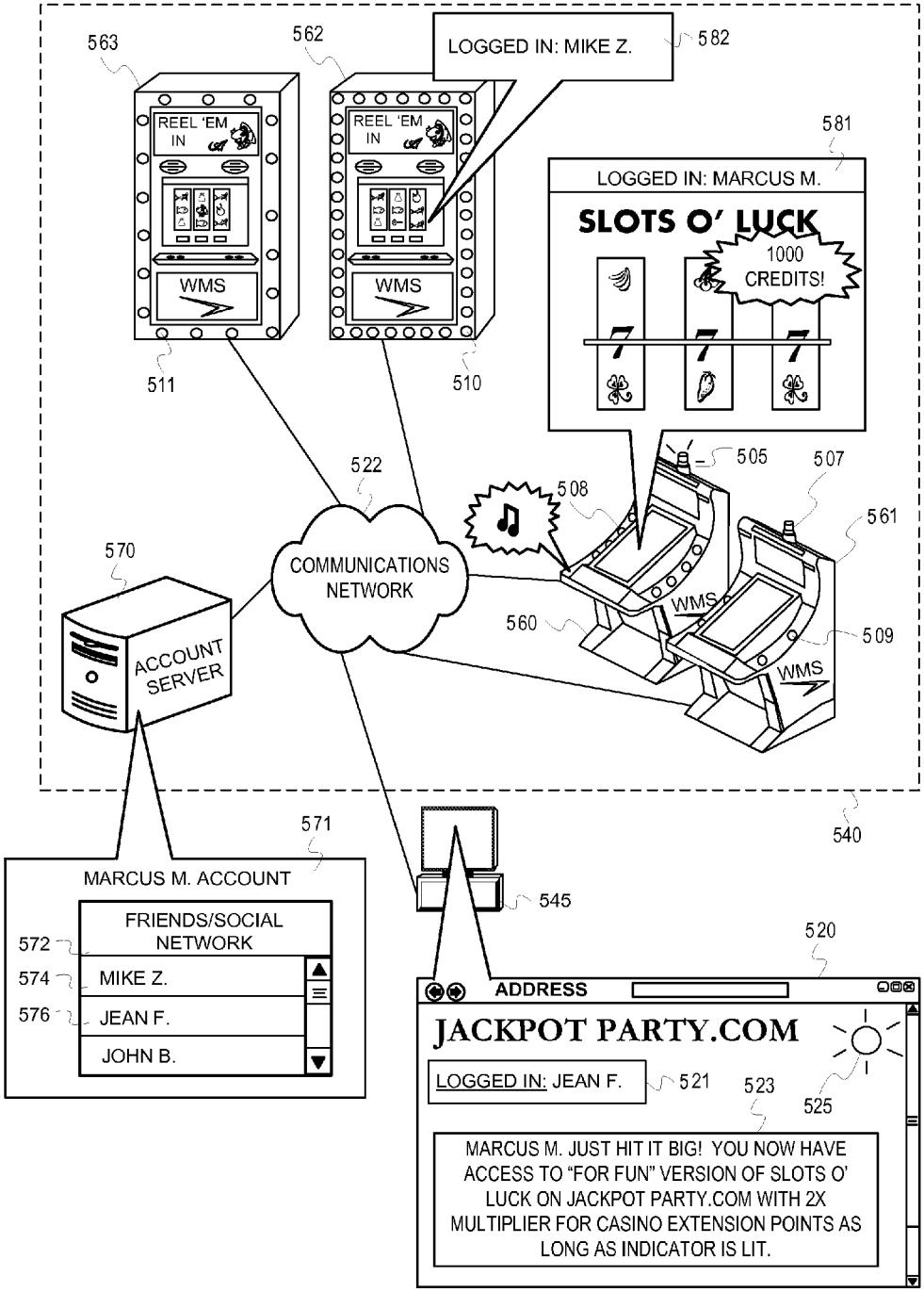
FIG. 5 is an illustration of controlling presentation and/or extension of mood-related gaming effects for groups, according to some embodiments.

FIG. 5 is a conceptual diagram that illustrates an example of controlling presentation and/or extension of mood-related gaming effects for groups, according to some embodiments. In FIG. 5, wagering game machines 560, 561, 562, and 563, in a casino 540, and are connected to a communications network 522. The system detects a triggering event of a first wagering game session for a first player account 571 associated with wagering game machine 560 (e.g., the first player account 571 is indicated via the login information 581). As a result, the system causes a mood-related gaming effect (e.g., a celebratory effect) to play at the wagering game machine 560. For instance, the system plays a light show on emotive lights 508, plays music, causes an overhead light (e.g., a "candle") 505 to turn on, etc. The system can also cause the celebratory effect to extend, such as according to one or more embodiments described previously. In some embodiments, the system also detects that an additional player account associated with the first player account 571 is concurrently engaged in an additional wagering game session via the wagering game machine 562 (e.g., second player account information is indicated via the login information 582) while the first player account 571 is engaged in the first wagering game session. For instance, the system accesses the first player account 571 via an account server 570. The first player account 571 includes a list of social contacts 572 (e.g., friends, family, social network contacts, etc.), such as a first social contact 574 (e.g., "Mike Z.") and a second social contact (e.g., "Jean F."). The second player account is associated with the first social contact 574 (i.e., "Mike Z") who is logged in to wagering game machine 562. Consequently, the system presents a version of the congratulatory gaming effect via the wagering game machine 562 (e.g., the system sends a light show to the wagering game machine 562, which lights up emotive lights 510). When the system extends the congratulatory gaming effect on the wagering game machine 560, the system can concurrently extend the version of the congratulatory gaming effect on the wagering game machine 562 across wager cycles for either the first player account 571 and/or the second player account. The duration of the extended presentation can be the same for both player accounts, or it can be different, such as based on subsequent events or conditions that occur or exist for either of the player accounts in their respective wagering game sessions. The system also detects that a third player account (associated with the second social contact 576) is logged in to a gaming website (as indicated by the login information 521) via a computer 545, as presented via a browser 520. In response to detecting the trigger event for the wagering game session of wagering game machine 560, the system causes an indicator 525 to turn on and stay turned on for the duration of the extended presentation of the celebratory effect at wagering game machine 560. The system can provide a benefit to the third player account (e.g., access to "for fun" games, wagering game benefits, multipliers, points, etc.). In some embodiments, the system can also present, and extend presentation, of a version of the celebratory effect to other player accounts that are not necessarily social contacts of the first player account. For example, the system determines that an additional player account is logged in to wagering game machine 561. The wagering game machines 560 and 561 are at a bank of machines within the casino 540 (e.g., linked via a bank controller). Because the wagering game machines 560 and 561 are linked at a bank, the system causes a version of the celebratory effect to play at the wagering game machine 561. The version of the celebratory effect presented at the wagering game machine 561 may be less intense than the celebratory effect presented at wagering game machine 560. For example, the system causes some, but not all, of the emotive lights 509 to play a light show. Further, the candle 507 does not light and no music is played at wagering game machine 561. The degree of intensity at which the version of the celebratory effect is played at the wagering game machine 561 can continue across stages (e.g., across wager cycles) similarly as for wagering game machine 560. Further, wagering game machine 563, which is associated with the second player account also presents a version of the celebratory effect (e.g., with a lesser intensity). The player account at wagering game machine 563 may be associated with the second player account as a social contact or because the wagering game machines 563 and 562 are linked together at a bank of machines. In other embodiments, the system determines that player accounts are associated when they are team members of a community wagering game, are engaged in a common task, or are related in some other way.

Extending Benefits Across Wager Cycles.

In some embodiments, the system provides benefits as a result of a triggering event beyond a mood-related gaming effect. Some benefits may include eligibility for other game-based events or features during subsequent stages (e.g., during subsequent wager cycles), an increased amount that can be won in subsequent bonus rounds at different stages, a decrease or increase in wagering game volatility in different stages, etc.

Customized Extension of Presentation.

In some embodiments, the system gives the player an option to specify factors that affect the extension of a presentation of a mood-related gaming effect. For example, the system can provide an interface via a wagering game machine through which a player can indicate a reduction to the duration of the extended presentation (e.g., player forces the extended presentation to end prior to a default setting), to select preferred elements of the extended presentation to last longer than others (e.g., player sets priorities of reduction for specific effect elements), and/or to set a minimum intensity level for one or more elements of the mood-related gaming effect (e.g., select whether the mood-related gaming effect turns off or instead drops to a minimum level that is not off).

Example Operating Environments

This section describes example operating environments, systems, networks, etc. and presents structural aspects of some embodiments.

Wagering Game System Architecture

Figure 6:
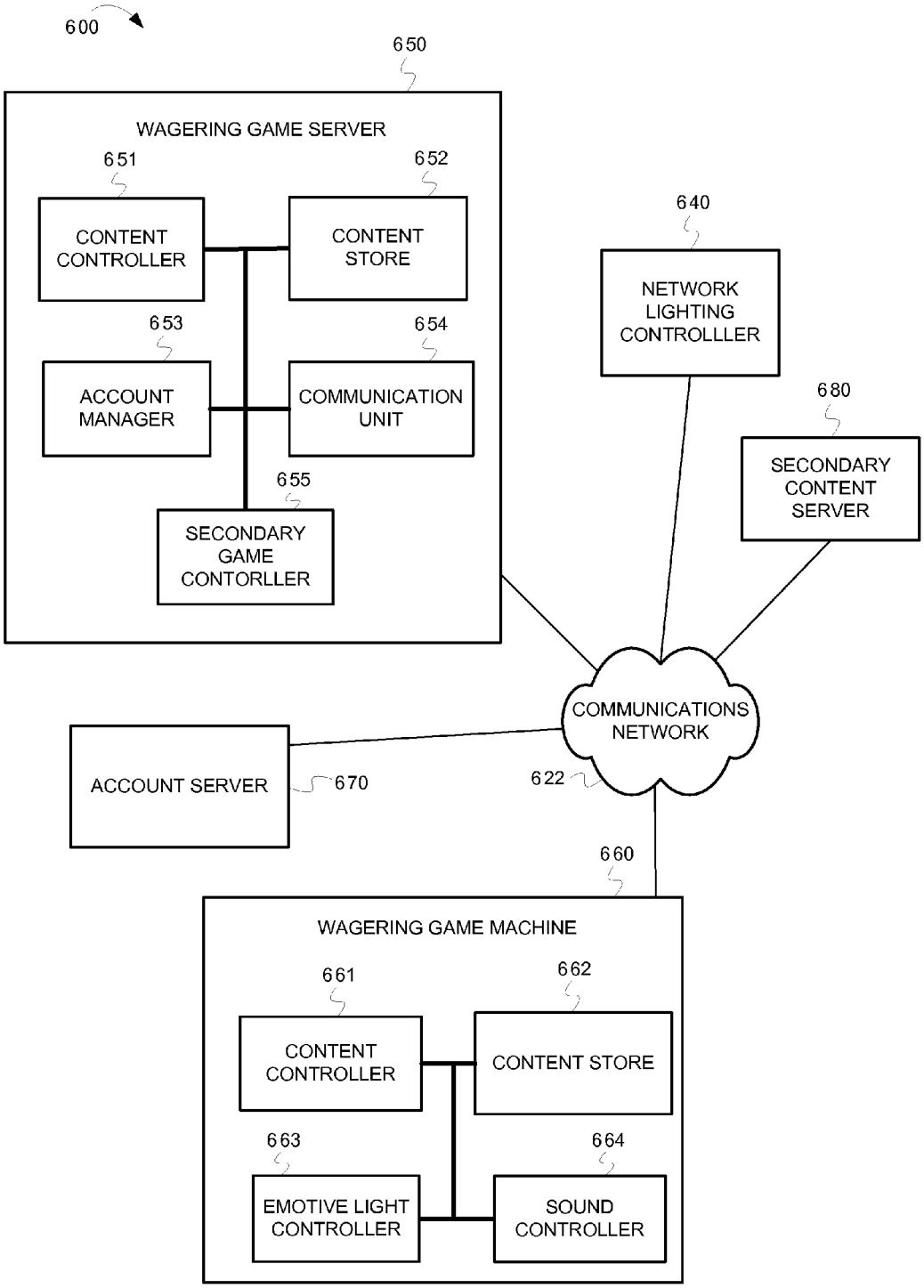
FIG. 6 is an illustration of a wagering game system architecture 600, according to some embodiments.

FIG. 6 is a conceptual diagram that illustrates an example of a wagering game system architecture 600, according to some embodiments. The wagering game system architecture 600 can include an account server 670 configured to control user related accounts accessible via wagering game networks and social networks. The account server 670 can store and track player information, such as identifying information (e.g., avatars, screen name, account identification numbers, etc.) or other information like financial account information, social contact information, etc. The account server 670 can contain accounts for social contacts referenced by the player account. The account server 670 can also provide auditing capabilities, according to regulatory rules, and track the performance of players, machines, and servers.

The wagering game system architecture 600 can also include a wagering game server 650 configured to control wagering game content, provide random numbers, and communicate wagering game information, account information, and other information to and from a wagering game machine 660. The wagering game server 650 can include a content controller 651 configured to manage and control content for the presentation of content on the wagering game machine 660. For example, the content controller 651 can generate game results (e.g., win/loss values), including win amounts, for games played on the wagering game machine 660. The content controller 651 can communicate the game results to the wagering game machine 660. The content controller 651 can also generate random numbers and provide them to the wagering game machine 660 so that the wagering game machine 660 can generate game results. The wagering game server 650 can also include a content store 652 configured to contain content to present on the wagering game machine 660. The wagering game server 650 can also include an account manager 653 configured to control information related to player accounts. For example, the account manager 653 can communicate wager amounts, game results amounts (e.g., win amounts), bonus game amounts, etc., to the account server 670. The wagering game server 650 can also include a communication unit 654 configured to communicate information to the wagering game machine 660 and to communicate with other systems, devices and networks. The wagering game server 650 can also include a secondary game controller 655 configured to control secondary game communications, content, and other information including, but not limited to, information about community wagering games.

The wagering game system architecture 600 can also include a wagering game machine 660 configured to present wagering games and receive and transmit information to control casino lighting content and sound. The wagering game machine 660 can include a content controller 661 configured to manage and control content and presentation of content on the wagering game machine 660. The wagering game machine 660 can also include a content store 662 configured to contain content to present on the wagering game machine 660. The wagering game machine 660 can be associated with an emotive light controller 663 configured to control communications including casino-content lighting control data. In some embodiments, the emotive light controller 663 can be included in the wagering game machine 660. In other embodiments, the emotive light controller 663 is associated with the wagering game machine 660, though not necessarily integral with, or included in, the wagering game machine 660. For example, in some embodiments, the emotive light controller 663 may be connected to, and control, emotive lighting devices that are attached to a cabinet for the wagering game machine 660, or that are proximate to, the wagering game machine 660. The wagering game machine 660 can also be associated with a sound controller 664 configured to determine sound content associated with casino-content lighting control data and present the sound content contemporaneously with (e.g., in synchronicity with, in direct connection with, immediately following) a presentation of casino lighting content. In some embodiments, the sound controller 660 also may be included in the wagering game machine 660. In other embodiments, however, the sound controller 660 may be associated with, but not necessarily a part of, the wagering game machine 660.

The wagering game system architecture 600 can also include a network lighting controller 640 configured to control environmental light presentation devices within a casino. The network lighting controller 640 can provide emotive lighting presentation data, including light presentation commands on emotive lighting devices on or near wagering game machines, as well as other devices within the casino such as spotlights, overhead emotive lighting, projectors, etc. The network lighting controller 640 can be configured to determine multi-media, casino-content, including casino-wide special effects that include sound effects and light effects. The multi-media casino content can be presentable across a plurality of casino content presentation devices ("presentation devices") in a casino. The multi-media, casino-content effect can be related to a wagering game presentation or event. The wagering game presentation or event can be tied to the functionality, activity, or purpose of a wagering game. For instance, wagering game presentations can be related to attracting wagering game players to groups of wagering game machines, presenting game related outcomes across multiple wagering game machines, expressing group gaming activity across multiple wagering game machines, focusing attention on a particular person or machine in response to a gaming event, etc. The network lighting controller 640 can also be configured to determine timing control data for the multi-media effect. In some embodiments, timing control data can be stored on the network lighting controller 640, or be accessible to the network lighting controller 640, to use to send lighting commands in sequential order to network addresses of presentation device on a casino network. The network lighting controller 640 can determine channels assigned with casino-content presentation devices, such as the wagering game machine 660. In some embodiments, the presentation devices can have an addresses assigned to a channel. For example, the wagering game machine 660 could be on one channel, peripheral devices could be on another channel, network light presentation devices can be on other channels, etc. In some embodiments, the network lighting controller 640 can be a DMX controller connected in parallel to the emotive lighting controller 663 on the wagering game machine 160. The DMX controller can also be connected in parallel to a plurality of other presentation devices (e.g., other wagering game machines, lighting presentation devices, etc.) within a casino, and can simultaneously provide DMX lighting commands to the wagering game machine 660 and to the other presentation devices. DMX can change light intensity, or other light characteristics, over time. Some embodiments of DMX controllers can update commands very quickly (e.g., thirty to forty seven times a second) across multiple channels (e.g., five-hundred and twelve channels). A DMX controller can put different commands in every channel (e.g., a first channel has a first show, a second channel has a second show, etc.). The DMX can also have a frame number within a show. Some devices can take up more than one channel (e.g., an emotive light might have three colors and may take up a channel for each color, a spotlight might have seven channels, etc.). Each device can receive five-hundred and twelve (512) bytes of data from the DMX controller at any given time interval (e.g., frame). The five-hundred and twelve bytes of data can be divided in different ways. For example, six bytes may address light effect behavior, six bytes may include show numbers, six bytes may include frame numbers, one byte may include priority values, and so on for various light effect characteristics (e.g., intensity, color, pan, tilt, etc.). The presentation device that receives the DMX command data is programmed to interpret the lighting data in the channel. In some embodiments, the presentation devices can be DMX compliant including having a DMX input port to accept DMX commands. In some embodiments, presentation devices can convert the DMX commands to proprietary commands. In addition to the DMX protocol, other types of dedicated lighting protocols can include AMX 192, CMX, SMX, PMX, protocols included in the EIA-485 standard, etc.

The wagering game system architecture 600 can also include a secondary content server 680 configured to provide content and control information for secondary games and other secondary content available on a wagering game network (e.g., secondary wagering game content, promotions content, advertising content, player tracking content, web content, etc.). The secondary content server 680 can provide "secondary" content, or content for "secondary" games presented on the wagering game machine 660. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. The secondary content server 680 can include one or more different servers or devices including a secondary game server (e.g., a bonus game server, etc.), a network game server (e.g., a progressive game server, a big event server), an advertising server, a community game server, etc. The secondary content server 680 can provide and control content for community games, including networked games, social games, competitive games, or any other game that multiple players can participate in at the same time.

Each component shown in the wagering game system architecture 600 is shown as a separate and distinct element connected via a communications network 622. However, some functions performed by one component could be performed by other components. For example, the wagering game server 650 can also be configured to perform functions of the emotive light controller 663, the sound controller 664, and other network elements and/or system devices. Furthermore, the components shown may all be contained in one device, but some, or all, may be included in, or performed by multiple devices, as in the configurations shown in FIG. 6 or other configurations not shown. For example, the account manager 653 and the communication unit 654 can be included in the wagering game machine 660 instead of, or in addition to, being a part of the wagering game server 650. Further, in some embodiments, the wagering game machine 660 can determine wagering game outcomes, generate random numbers, etc. instead of, or in addition to, the wagering game server 650.

The wagering game machines described herein (e.g., wagering game machine 660 can take any suitable form, such as floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Some embodiments of the inventive subject matter describe examples of extending presentation of mood-related gaming effects in a network wagering venue (e.g., an online casino, a wagering game website, a wagering network, etc.) using a communication network (such as the communications network 622). Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Furthermore, the wagering game system architecture 600 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

Figure 7:
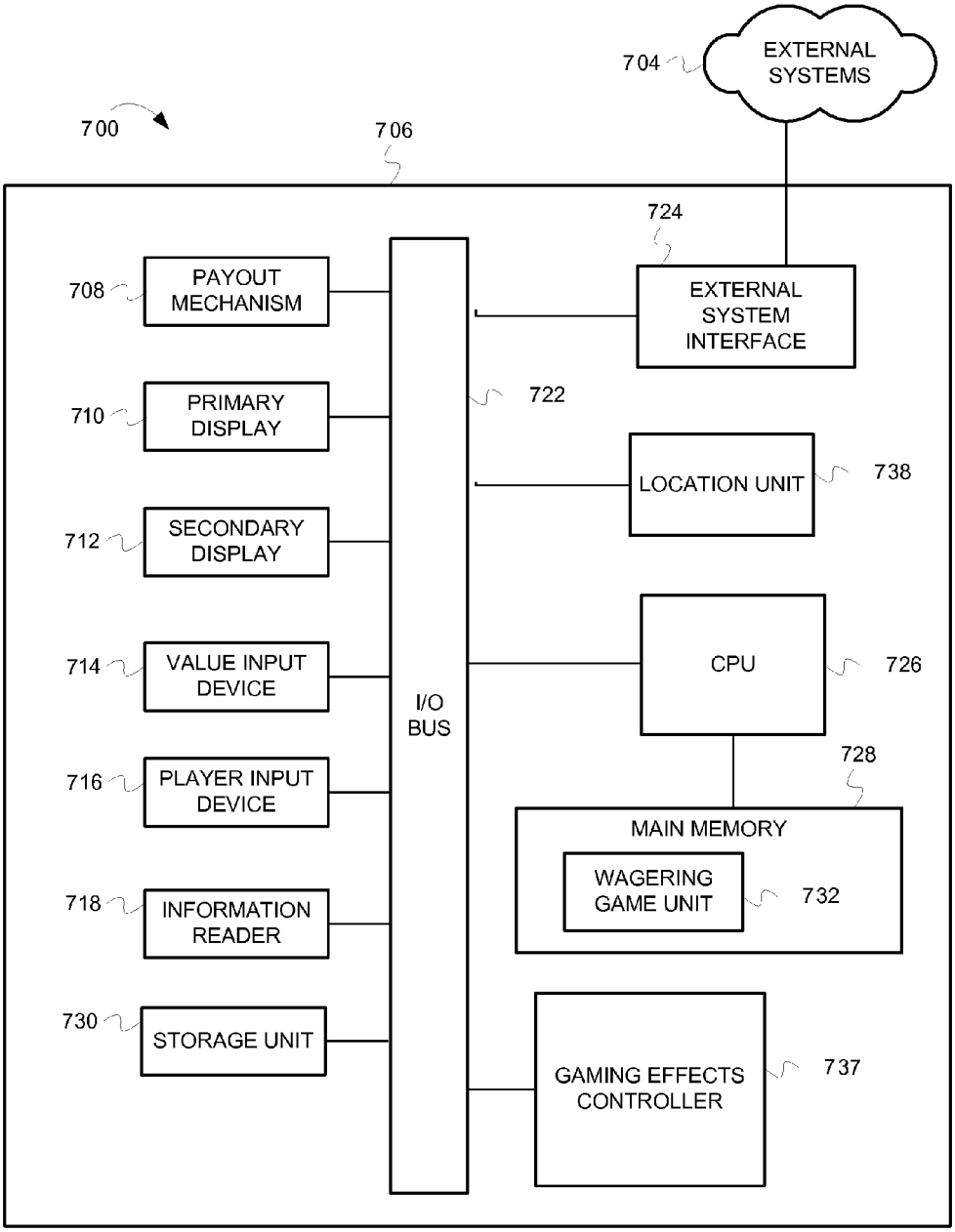
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes a gaming effects controller 737. The gaming effects controller 737 can process communications, commands, or other information, where the processing can extend presentation of mood-related gaming effects.

Furthermore, any component of the wagering game machine 706 can include hardware, firmware, and/or machine-readable storage media including instructions for performing the operations described herein.

Wagering Game System

Figure 8:
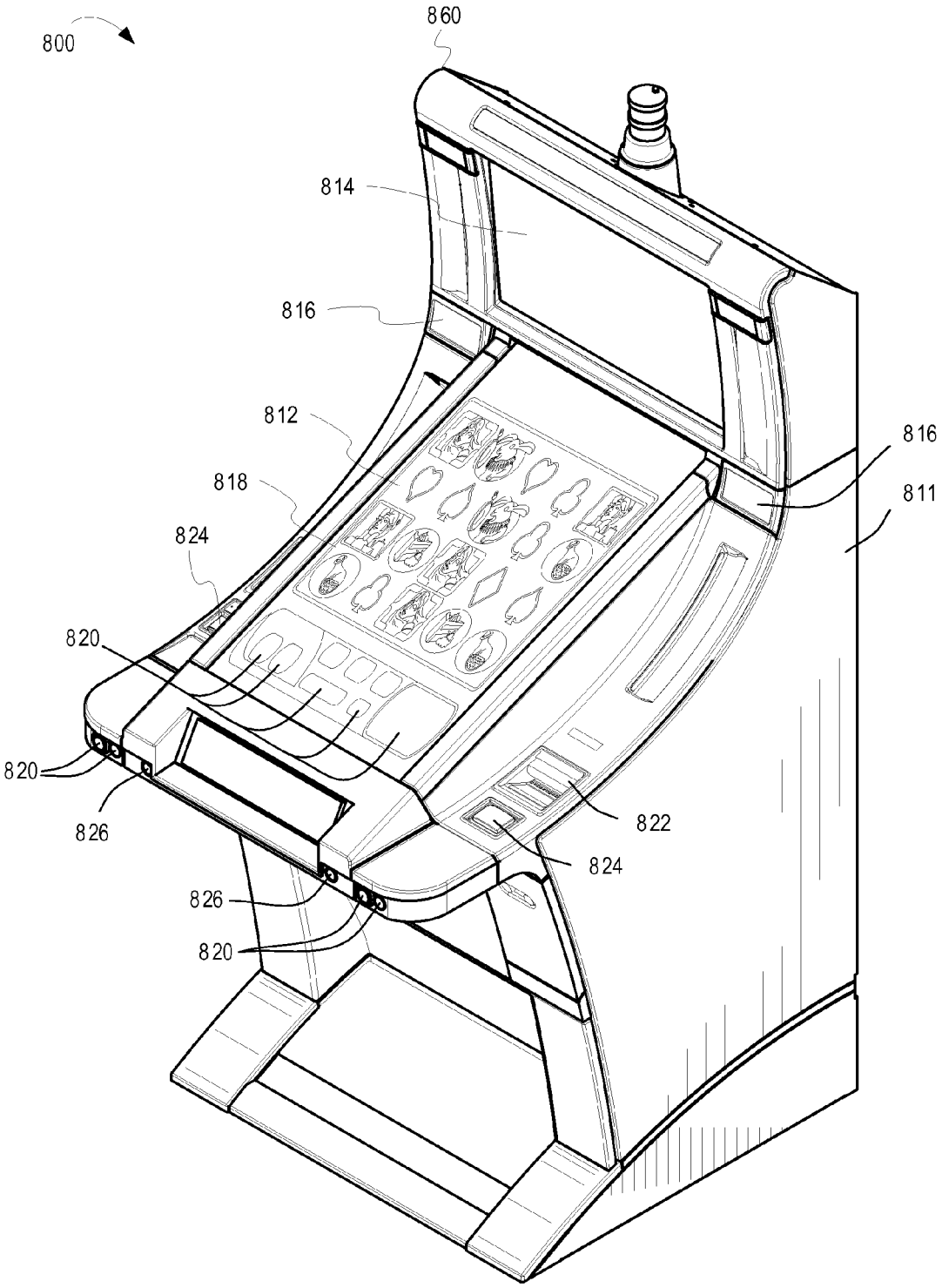
FIG. 8 is an illustration of a wagering game system 800, according to some embodiments.

FIG. 8 is a conceptual diagram that illustrates an example of a wagering game system 800, according to some embodiments. In FIG. 8, the wagering game system 800 includes a wagering game machine 860 similar to those used in gaming establishments, such as casinos. The wagering game machine 860 may, in some examples, be referred to as a gaming terminal or an electronic gaming machine. The wagering game machine 860 may have varying structures and methods of operation. For example, the wagering game machine 860 may include electromechanical components configured to play mechanical slots. In another example, the 860 includes electronic components configured to play a video casino game, such as slots, keno, poker, blackjack, roulette, craps, etc. The wagering game machine 860 is depicted as a floor-standing model. However, other examples of wagering game machines include handheld mobile units, bartop models, workstation-type console models, etc. Further, the wagering game machine 860 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 860 illustrated in FIG. 8 comprises a cabinet 811 that may house various input devices, output devices, and input/output devices. By way of example, the wagering game machine 860 includes a primary display area 812, a secondary display area 814, and one or more audio speakers 816. The primary display area 812 or the secondary display area 814 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 812 or the secondary display area 814 includes mechanical reels to display a wagering game outcome. In some example, the primary display area 812 or the secondary display area 814 present a transmissive video display disposed in front of a mechanical-reel display to portray a video image superimposed upon the mechanical-reel display. In FIG. 8, the wagering game machine 860 is a "slant-top" version in which the primary display 812 is slanted (e.g., at about a thirty-degree angle toward the player of the wagering game machine 860). Another example of wagering game machine 860 is an "upright" version in which the primary display 814 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 860. The wagering game machine 860 includes a touch screen(s) 818 mounted over the primary or secondary areas, buttons 820 on a button panel, bill validator 822, information reader/writer(s) 824, and player-accessible port(s) 826 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 818, buttons 820, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

detecting, via one or more processors, a winning event associated with a wagering game machine, the winning event occurring during a first wager cycle of a wagering game;

in response to detecting the winning event, presenting, on an output device associated with the wagering game machine, a congratulatory gaming effect during the first wager cycle;

presenting, via the output device associated with the wagering game machine, the congratulatory gaming effect after the first wager cycle and into a plurality of wager cycles subsequent to the first wager cycle; and decreasing an intensity output value of the congratulatory gaming effect to the output device for each of the plurality of wager cycles subsequent to the first wager cycle.

2. The computer-implemented method of claim 1 further comprising:

replacing first parameters for a default duration of the congratulatory gaming effect with second parameters for an extended duration of the congratulatory gaming effect, wherein the first parameters cause an intensity reduction of the congratulatory gaming effect to occur at a first rate, and wherein the second parameters cause an intensity reduction of the congratulatory gaming effect to occur at a second rate less than the first rate.

3. The computer-implemented method of claim 1, wherein the first wager cycle comprises a transaction of a first wager via a player account associated with the wagering game session, and wherein the plurality of additional wager cycles comprise a plurality of transactions of additional wagers via the player account subsequent to the transaction of the first wager.

4. The computer-implemented method of claim 1, wherein the wagering game session is associated with a player account and further comprising:

detecting that an additional player account associated with the player account is concurrently engaged in an additional wagering game session via an additional wagering game machine while the player account is engaged in the wagering game session; and presenting at least a portion of the congratulatory gaming effect, via an output device associated with the additional wagering game machine, across subsequent wager cycles associated with one or more of the wagering game session and the additional wagering game session.

5. The computer-implemented method of claim 4, wherein the determining that the additional player account is associated with the player account comprises one or more of, determining that the additional player account is listed as a social contact of the player account, determining that the additional player account is a team member of the player account during a community wagering game presented during the wagering game session, and determining that the additional player account is logged in to another wagering game machine at a bank of linked wagering game machines associated with the wagering game machine.

6. The computer-implemented method of claim 1, wherein the congratulatory effect is presented via at least one hardware device associated with a wagering game machine other than a display on which the wagering game is presented.

7. The computer-implemented method of claim 1, wherein the presenting of the congratulatory gaming effect after the first wager cycle comprises:

determining a duration for the congratulatory gaming effect based on one or more of a characteristic of the winning event, a characteristic of a player account associated with the wager cycle, an additional event that occurs prior to or after the first wager cycle, a condition that exists prior to or after the first wager cycle, a spin history of a player account associated with the wager cycle, an average speed of play of a player account associated with the wager cycle, an amount wagered over time by a player account associated with the wager cycle, an amount of time of play of a player account associated with the wager cycle, a prior advantageous outcome, a player status of a player account associated with the wager cycle, and an amount of points collected by a player account associated with the wager cycle.

8. One or more non-transitory, machine-readable storage devices having instructions stored thereon, which when executed by a set of one or more processors causes the set of one or more processors to perform operations comprising:

detecting a winning event during a first wager cycle of a wagering game played during a wagering game session on a wagering game machine;

causing, in response to detecting the winning event, presentation of a congratulatory gaming effect via an output device associated with the wagering game machine, during the first wager cycle;

causing presentation of the congratulatory gaming effect via the output device for a duration after the first wager cycle and into a second wager cycle subsequent to the first wager cycle; and replacing first parameters, for a default presentation duration of the congratulatory gaming effect, with second parameters for an extended presentation duration of the congratulatory gaming effect, wherein the first parameters cause an intensity reduction of the congratulatory gaming effect to occur at a first rate, and wherein the second parameters cause an intensity reduction of the congratulatory gaming effect to occur at a second rate less than the first rate.

9. The one or more non-transitory, machine-readable storage devices of claim 8, said operations further comprising:

determining a first output intensity value for the congratulatory gaming effect during the first wager cycle, wherein the first output intensity value causes presentation of the congratulatory gaming effect at a first intensity level; and determining a second output intensity value for the congratulatory gaming effect for the second wager cycle, wherein the second output intensity value causes presentation of the congratulatory gaming effect at a second intensity level less than the first intensity level.

10. The one or more non-transitory, machine-readable storage devices of claim 8, wherein the first wager cycle comprises a transaction of a first wager via a player account associated with the wagering game session and a presentation of the winning event, and wherein the second wager cycle comprises a transaction of a second wager via the player account subsequent to the transaction of the first wager and the presentation of the winning event.

11. The one or more non-transitory, machine-readable storage devices of claim 8, wherein the operation for causing presentation of the congratulatory effect via the output device includes an operation causing presentation of the congratulatory effect via one or more of an environmental lighting device and an external speaker associated with the wagering game machine.

12. A system comprising:

at least one input device configured to receive an indication of a wager to play a wagering game;

at least one output device configured to present content for the wagering game;

at least one processor; and at least one memory device configured to store instructions which, when executed by the at least one processor, cause the system to detect a winning event during a first wager cycle of a wagering game played during a wagering game session, in response to the winning event, present, via the at least one output device, a congratulatory gaming effect for the winning event during the first wager cycle, wherein the first wager cycle comprises a transaction of a first wager via a first player input of the wagering game session and a presentation of the winning event, and cause presentation of the congratulatory gaming effect to continue via the at least one output device for a duration after the wager cycle and into one or more additional wager cycles subsequent to the wager cycle, wherein the one or more additional wager cycles comprise one or more additional transactions of one or more additional wagers via one or more additional player inputs of the wagering game session subsequent to the transaction of the first wager and the presentation of the winning event, and wherein the one or more additional wagers result in one or more losing events.

13. The system of claim 12, wherein the instruction to cause the presentation of the congratulatory gaming effect to continue for the duration after the wager cycle comprises an instruction to reduce an intensity of the congratulatory gaming effect for each of the one or more subsequent wager cycles until the intensity of the congratulatory gaming effect reaches a minimum output level.

14. The system of claim 12, wherein the instruction to cause presentation of the congratulatory gaming effect to continue via the at least one output device for a duration after the wager cycle and into the one or more subsequent wager cycles includes an instruction to replace first presentation parameters with second presentation parameters, wherein the first parameters cause presentation of the congratulatory gaming effect to end after the first wager cycle, and wherein the second parameters cause presentation of the congratulatory gaming effect to extend presentation beyond the first wager cycle and into the one or more subsequent wager cycles.

15. The system of claim 14, wherein the instruction to replace the first presentation parameters with the second presentation parameters is based on an additional event performed via a player account associated with the wagering game session prior to the first wager cycle.

16. The system of claim 12, wherein the first wager and the one or more additional wagers are made via a player account associated with the wagering game session.

17. An apparatus comprising:

at least one input device configured to receive an indication of a wager to play a wagering game;

at least one display device configured to display the wagering game;

at least one processor; and at least one memory device configured to store instructions which, when executed by the at least one processor, cause the apparatus to detect a winning event during a wager cycle of a wagering game played during a first wagering game session, wherein the first wagering game session is associated with a first player account, in response to the winning event, present a congratulatory gaming effect, determine that a second player account associated with the first player account is concurrently engaged in a second wagering game session while the player account is engaged in the first wagering game session, present at least a portion of the congratulatory gaming effect in association with the second wagering game session, and extend presentation of the at least the portion of the congratulatory gaming effect across subsequent wager cycles associated with one or more of the first wagering game session and the second wagering game session.

18. The apparatus of claim 17, wherein the instruction to determine that the second player account associated with the first player account is concurrently engaged in a second wagering game session is configured to one or more of, determine that the second player account is listed as a social contact of the first player account, determine that the second player account is a team member of the first player account during a community wagering game presented during the first wagering game session, and determine that the second player account is logged in to a wagering game machine at a bank of linked wagering game machines associated with the first wagering game session.

19. The apparatus of claim 17, wherein the instruction to extend presentation of the at least the portion of the congratulatory gaming effect across the subsequent wager cycles is configured to reduce an intensity of the congratulatory gaming effect in stages over the duration, wherein the instruction to reduce the intensity in stages comprises decreasing the intensity of the at least one element of the congratulatory gaming effect for each one of the subsequent wager cycles.

20. The apparatus of claim 17, wherein the instructions which, when executed by the at least one processor, further cause the apparatus to based on a prior event that occurred in association with the player account prior to the winning event, one or more of select an effect type to present for the congratulatory gaming effect, set an initial effect intensity of the congratulatory gaming effect, and select a number of elements of the congratulatory gaming effect.

21. An apparatus comprising:

means for detecting a winning event during a first wager cycle of a wagering game played during a wagering game session wherein the winning event includes a winning outcome of a playing turn of the wagering game for a wager made during the first wager cycle;

means for presenting a congratulatory gaming effect in response to the winning event;

means for extending presentation of the congratulatory gaming effect for a duration after the wager cycle, wherein the congratulatory gaming effect has a reduction rate that reduces intensity of the congratulatory gaming effect for one or more wager cycles subsequent to the first wager cycle; and means for modifying the reduction rate of the congratulatory gaming effect based on an additional event that occurs after the first wager cycle.

22. The apparatus of claim 21, wherein the means for modifying the reduction rate of the congratulatory gaming effect based on the additional event that occurs after the first wager cycle comprises means for one or more of increasing the intensity of the congratulatory gaming effect based on the additional event, decreasing the intensity of the congratulatory gaming effect based on the additional event, and preventing a change to the intensity of the congratulatory gaming effect for at least one of the one or more wager cycles subsequent to the first wager cycle based on the additional event.

23. The apparatus of claim 21, wherein the additional event comprises one or more of a spin history of a player account, an average speed of play, an amount wagered over time, an amount of time of play of a player account, a prior advantageous outcome, a player status, and an amount of points collected.

* * * * *